US005463171A

United States Patent [19]

Nishi et al.

[11] Patent Number: 5,463,171

[45] Date of Patent: Oct. 31, 1995

[54] METHOD FOR SOLIDIFICATION OF WASTE, AND APPARATUS, WASTE FORM, AND SOLIDIFYING MATERIAL THEREFOR

[75] Inventors: Takashi Nishi; Masami Matsuda; Kenji Noshita; Makoto Kikuchi, all of Hitachi; Tatsuo Izumida, Katsuta; Shin Tamata, Ooarai; Yoshimasa Kiuchi, Katsuta, all of Japan

[73] Assignee: Hitachi, Ltd., Tokyo, Japan

[21] Appl. No.: 123,359

[22] Filed: Sep. 17, 1993

[30] Foreign Application Priority Data

Sep. 18, 1992 [JP] Japan ..... 4-249937

[51] Int. Cl.[6] ..... G21F 9/00

[52] U.S. Cl. ..... 588/4; 588/14; 588/251; 588/256

[58] Field of Search ..... 588/4, 5, 14, 251, 588/256

[56] References Cited

U.S. PATENT DOCUMENTS

| | | | |
|---|---|---|---|
| 3,837,872 | 9/1974 | Conner | 106/74 |
| 4,129,518 | 12/1978 | Huppert et al. | 252/301.1 W |
| 4,505,851 | 3/1985 | Funabashi et al. | 252/628 |
| 4,659,511 | 4/1987 | Fukasawa et al. | 252/628 |
| 4,671,897 | 6/1987 | Mori et al. | 252/628 |
| 4,671,898 | 6/1987 | Hultgren | 252/628 |
| 4,775,495 | 10/1988 | Izumida et al. | 252/628 |
| 4,943,394 | 7/1990 | Lammertz et al. | 252/628 |
| 5,045,241 | 9/1991 | Kuriyama et al. | 252/628 |
| 5,049,285 | 9/1991 | Somerville et al. | 210/710 |

*Primary Examiner*—Ngoclan Mai

*Attorney, Agent, or Firm*—Antonelli, Terry, Stout & Kraus

[57] ABSTRACT

Objective of the present invention is to provide a preferable solidified body ensuring performance of artificial barrier in a solidifying process for incombustible miscellaneous solid waste and other wastes such as calcined ashes by preventing generation of hydrogen gas by a reaction of amphoteric metal included in the waste with solidifying materials.

In order to suppress the reaction of the amphoteric metal with the solidifying materials, any one or arbitrary plurality of the following three means are provided in the solidifying materials;

(1) A means for forming protection film on surface of the amphoteric metal, (2) A means for enhancing hydration reaction of cement, (3) A means for reducing basicity of the solidifying materials.

In accordance with the present invention, a preferable solidified body can be obtained by a simple and easy method which does not necessitate separation and pre-treatment of the waste.

17 Claims, 8 Drawing Sheets

METHOD FOR SOLIDIFICATION OF WASTE, AND APPARATUS, WASTE FORM, AND SOLIDIFYING MATERIAL THEREFOR

BACKGROUND OF THE INVENTION

1. Field of the Invention

The present invention relates to methods for solidification of waste, apparatus and solidifying materials therefor, and waste forms thereby, especially, to methods for solidification of incombustible miscellaneous solid waste generated from nuclear power stations and calcined ashes generated by calcining treatment of burnable miscellaneous solid waste, apparatus therefor, solidifying materials therefor, and waste forms obtained by the solidifying method.

2. Prior Art

In order to make a final burial treatment to underground of radioactive waste generated from nuclear power plants etc, a treatment for preventing radioactive nuclides contained in the waste from dispersing outside must be performed previously. That is, it is required to add artificial barriers to the waste by solidifying the waste to form stable bodies in exclusive vessels. As for solidifying materials therefor, asphalt, plastics, hydraulic solidifying material such as cements, mortar, and concrete are general, inexpensive, and preferable in characteristics such as mechanical strength etc, and therefore, they have been used widely as solidifying materials for both radioactive and non-radioactive waste. Particularly, the solidifying materials of cement group have been widely used because of their low price and easiness in handling and solidifying operation.

Generally, cements are strongly basic, and are preferable for artificial barriers to seal radioactive nuclides because they solidify the radioactive nuclides such as cobalt-60, nickel-63, and transuranic elements as hydroxide precipitates. Preferable heat resistance and radiation resistance are other advantages of the cements.

As for the radioactive waste generated from nuclear power plants, there are incombustible miscellaneous solid waste such as pipes, valves, metallic waste materials, insulator, concrete chips, and used HEPA filters etc, all of which are generated at operation sites such as periodic inspection etc. Further, there is the calcined ashes generated from calcining treatment of burnable miscellaneous solid waste. In the calcining ashes generated from calcination of burnable waste and the incombustible miscellaneous solid waste, metals such as aluminum and zinc are often included. Particularly, in a gas cooled reactor, aluminum alloy is used as a material for a splitter composing Magnox nuclear fuel, and accordingly, aluminum alloy waste is generated from reprocessing of spent fuel. Therefore, development of technology for solidification of these waste with integral artificial barriers to the above metals is required. However, actually at the present, these waste are packed in drum cans and stored within the site of the power station, and hence, solidification of the waste to stable solidified waste forms and burial treatment to underground are strongly desired.

It has been pointed out that, when the incombustible miscellaneous solid waste and calcined ashes are solidified with basic solidifying material such as cements etc, waste forms having undesired characteristics are often produced. As for the reason, it has been revealed that metallic chips or metallic powder which generate hydrogen gas by reacting with basic components of the cement are slightly included in these waste, and the hydrogen gas generates bubbles and cracks in the waste forms. However, these metals have the same appearance, and it is physically difficult to separate only the undesired metallic chips and metallic powder from the waste.

Prior art to solve the above problems are disclosed in JP-B-2-62200 (1990), JP-A-4-200680 (1992), and JP-A-5751163 (1982).

According to JP-B-2-62200 (1990), when calcined ashes are solidified with cement, a method is disclosed to suppress generation of hydrogen gas after mixing the cement and the calcined ashes by previously mixing the calcined ashes with basic material to complete somewhat the generation of hydrogen gas before the solidification. In the same reference, it is also disclosed that ZnO and PbO in the calcined ashes disturb proceeding of hydration reaction at the solidification of the cement.

However, in accordance with the former method, pretreatment process is required for cement solidification of the calcined ashes, and accordingly, it takes long time for the pre-treatment when a large amount of metals such as aluminum are included in the ashes. On the contrary, the pre-treatment performed on the calcined ashes which do not include the amphoteric metals wastes time and expense. Further, as metals are dissolved in the pre-treatment process, the process causes dispersion of radioactive nuclides into the process solution when the metals are contaminated or radioactive, and consequently, it requires other countermeasure to ensure isolating function as the artificial barriers for the waste form. Furthermore, it is not desirable in view of safety to generate a large amount of combustible hydrogen gas at the pre-treatment process.

The latter description on the hydration reaction discloses only disturbance in the proceeding of hydration reaction by ZnO and PbO at the cement solidification, and does not relate at all to the gist of the present invention which claims that enhancing the hydration reaction makes it possible to suppress generation of hydrogen gas.

The second reference, JP-A-4-200680 (1992), discloses a method for preparing a solid form suppressing generation of hydrogen gas by controlling basic components in the cement at the solidifying process so that the pH of the cement paste, which is a mixture after mixing process of the cement, is reduced to utmost 13 when incombustible miscellaneous solid waste containing aluminum is solidified with the cement.

However, in accordance with the above method, it is possible to reduce generation of hydrogen gas somewhat by controlling pH of the cement paste, but it is impossible to reduce the amount of the hydrogen gas to a level deemed to be approximately zero. Furthermore, as being strongly basic is indispensable condition for stable solidification of cobalt-60 and nickel-63 etc as described previously, excessive lowering of pH reduces the essential function of the cement to solidify the radioactive nuclides stably.

The problem that metals react with basic materials such as cement and generate hydrogen gas is not typical of radioactive waste treatment, but also it is regarded as a problem in the field of general industrial waste. Regarding to a phenomenon that aluminum reacts with basic material to generate hydrogen gas when additives or binders which are equivalent to the solidifying material are added to the calcined ashes of urban waste or industrial waste, JP-A-57-51163 (1982) discloses two methods the one in which a desired waste form can be obtained under a nearly neutral condition as the pH is in a range between 5–9 where aluminum does not generate hydrogen gas and stable, and another method in which a waste form having superior characteristics can be obtained by preparing a waste form after reacting all the contained aluminum previously under a strong basic condition of the pH 10–12.

However, the former method has a difficulty in solidifying medium having the pH other than 5–9 (for instance, hydraulic solidifying materials of cement groups). The latter method has the same problem as JP-B-2-62200 (1990) which similarly treats the contained aluminum previously with an alkaline atmosphere.

SUMMARY OF THE INVENTION

(1) Objects of the Invention

The first object of the present invention is to provide a method for solidifying waste which does not require a pretreatment of the waste and/or a separation treatment of the waste when solidifying the waste with basic solidifying materials, utilizes the characteristics of the solidifying materials sufficiently, and is capable of suppressing hydrogen gas generation caused by a reaction of the solidifying materials and amphoteric metals contained in the waste, apparatus therefor, waste forms thereof, and the solidifying materials therefor.

The second object of the present invention is to provide a method for solidifying waste in which a pretreatment of the waste can suppress generating hydrogen gas caused by a reaction of the solidifying materials and amphoteric metals contained in the waste when solidifying the waste with basic solidifying materials, apparatus therefor, waste forms thereof, and the solidifying materials therefor.

The third object of the present invention is to provide a method for solidifying waste in which hydrogen gas generation caused by a reaction of the solidifying materials and amphoteric metals contained in the waste can be suppressed to nearly zero when solidifying the waste with basic solidifying materials, apparatus therefor, and waste forms in which the generation of hydrogen gas is nearly zero.

(2) Methods of solving the Problems

In a process for solidifying waste with basic solidifying materials, the first and the second objects described above can be realized by preparing protecting film on the surface of the amphoteric metals contained in the waste at the solidification treatment.

In a process for solidifying waste with basic solidifying materials, the second object described above can be realized by preparing protecting film on the surface of the amphoteric metals contained in the waste prior to the solidification treatment.

In a process for solidifying waste with basic solidifying materials, the first and the second objects described above can be realized by enhancing a hydration reaction of the solidifying materials at the solidification treatment.

In a process for solidifying waste with basic solidifying materials, the third object described above can be realized by using at least two means selected from a group of means, that is, preparing protecting film on the surface of the amphoteric metals contained in the waste, enhancing a hydration reaction of the solidifying materials, and lowering natural basicity of the solidifying materials.

The amphoteric metal referred to in the present invention are metals which can be dissolved in both acidic and basic solutions to be ionized, and generates hydrogen gas concurrently. Concretely saying, aluminum, zinc, tin, lead, and alloys of which main component is one of the above metals are the amphoteric metals.

The basic solidifying materials referred to in the present invention are generally hydraulic solidifying materials of cement group. The hydraulic solidifying materials of the cement group include pastes obtained by mixing water with ordinary portland cement including CaO, $SiO_2$, and $Al_2O_3$ as main components, rapid hardening portland cement, sulfate resisting portland cement, blust-furnace slag cement, Pozzolan cement, sodium silicate (water glass), fly ash cement, alumina cement, expansive cement, oil well cement, etc, mortars obtained by mixing powder aggregate such as sand etc to the pastes, and concretes obtained by mixing granular aggregate such as gravel to the mortars.

A reaction of the basic solidifying material with the amphoteric metal can be schematically expressed by the following equation;

$$\text{metal} + \text{water} + \text{hydroxyl ion} \longrightarrow \text{metal hydroxyl ion} + \text{hydrogen} \qquad \text{(equation 1)}$$

Referring to the equation 1, means for solving the problems are explained hereinafter.

The first means for preparing protecting film is explained. In accordance with the present means, the metal in the left side of the equation 1 is reacted so that the protecting film, that is a layer which delays diffusion of ions, is formed at the surface of the metal, and consequently, the reaction rate of the equation 1 decreases. That means decreasing of hydrogen gas generation. In order to form the above protecting film, it is preferable to add a reagent. The protecting film can roughly be classified in three types such as (1) oxide film (passive state), (2) precipitated film, (3) adsorbed film.

Experiments performed by the present inventors revealed that among the above films, the oxide film of the amphoteric metal does not have any resistivity in basic environment, and accordingly, the reagent of a type forming the oxide film is not adequate for being used with basic solidifying materials, and that the reagent forming the precipitated film or the adsorbed film is suitable for being used with basic solidifying materials.

As for the reagent which forms an insoluble precipitated film at the surface of the amphoteric metal, there are inorganic phosphates and their neutral salts, organic phosphates and their neutral salts (phosphoric acid salts), polyphosphates and their neutral salts, silicon polyphosphate, silicates and their neutral salts, polysilicates and their neutral salts, nitrates, inorganic salts containing lithium, etc.

As for the reagent which forms an adsorbed film electrostatically or chemically at the surface of the metal, there are organic compounds including elements having strong electronegativity as nitrogen, oxygen, phosphor, and sulfur in polar groups such as amines, mercaptan and alkylbenzenesulphonates, and chelating agents such as hydroxy quinoline etc. When the above described reagents are used for solidification of waste by blending with the solidifying materials and mixing with water, the reagents dissolve and are dispersed in the water, and form the film by reacting with the amphoteric metal in the waste at the surface of the metal.

Additive amounts of the reagents are preferably 0.1–10% to the amount of the solidifying material, and any of the protecting film forming methods by direct reaction of the reagent with the metal before the solidification, by blending the reagent with the solidifying material powder or mixing water before mixing the solidifying material, and by adding the reagent to the paste after mixing causes the same advantages.

Therefore, in accordance with the first means, both of the first and the second objects can be realized.

Next, the second means which enhances hydration reaction of the solidifying material such as cements is explained. The present means has a function to crystalize the water (free water) contributing the reaction shown at the left side of the equation 1 rapidly, that means the reaction rate of the reaction expressed by the equation 1 is decreased by enhancing the hydration reaction of the cement, and accordingly, hydrogen gas generation rate is decreased. In order to enhance the hydration reaction, it is desirable to add reagents for enhancing the hydration reaction such as inorganic salts including calcium (for instance, calcium chloride, calcium nitrate etc), sodium silicates (water glass), aluminic acid calcium salts which is a sintered body of $CaO.Al_2O_3$, alunite, etc. The above described reagents have a function to crystalize the free water rapidly by either of or both of operations such as (1) enhancing the hydration reaction of the cement components by increasing calcium concentration in the solidifying material paste, and (2) making a new hydrated compound by reacting the added reagent itself with the cement components. Furthermore, the inventors revealed experimentally that the above described inorganic salts including calcium, and polyphosphates, have a preferable property to have both functions concurrently to form the protecting film at the surface of the amphoteric metal and to enhance the hydration reaction of the cement.

Additive amounts of the reagents are desirably 0.1–10% preferably 0.1–5%, to the amount of the solidifying material because the addition more than 10% causes unfavorable effect in solidification of the solidifying material, and any of the protecting film forming methods by blending the reagent with the solidifying material powder before mixing of the solidifying material, and by adding the reagent to the paste after the mixing causes the same advantages.

Therefore, in accordance with the second means, both of the first and the second objects can be realized.

Finally, the third means which decreases basicity of the solidifying materials is explained. The present means decreases the reaction rate of the equation 1 by a function to decrease hydroxy ions (lowering the pH) in the solidifying material paste. That means, decreasing the hydrogen gas generation rate. For instance, taking cement for the solidifying material. Basic components in the cement such as $Na_2O$, $K_2O$, CaO show basicity by the following reaction when the cement is mixed with water;

$$Na_2O+water \rightarrow 2NaOH$$

$$K_2O+water \rightarrow 2KOH \qquad \text{... (equation 2)}$$

$$CaO+water \rightarrow Ca(OH)_2$$

Therefore, as for the methods for decreasing basicity of the solidifying material, that is, the methods for decreasing content of the basic components, $Na_2O$, $K_2O$, CaO, in the solidifying material are (1) a method using low alkaline cement, or white cement of which content of basic components such as $Na_2O$, $K_2O$ are naturally small, and (2) a method for decreasing content of the basic components such as $Na_2O$, $K_2$, CaO, in the solidifying material by diluting the components with blending inorganic material of which main components are $SiO_2$, and $Al_2O_3$, that is, contents of the $Na_2O$, $K_2O$, CaO, in the solidifying material are decreased by replacing with oxides such as $SiO_2$, $Al_2O_3$, etc. Of course, it is possible to decrease basicity to a favorable extent by applying the method (2) to the method (1). As for the inorganic materials including $SiO_2$, $Al_2O_3$ as main components, aggregates such as sand and gravel etc, and by-products from general industries such as blust-furnace slag, silica fume, and fly ashes, etc are adequate, but when natural inorganic material having an adsorption property for radioactive nuclides such as montmorillonite, vermiculite, clinoptilolite, cristobalite, kaorinite, etc are added, an additional effect to improve performance as an artificial barrier for the solid form can be added.

Additive amounts of the inorganic materials can be selected from a range of 5–80% to the solid materials which is a sum of the cement and the additive materials, but a range 30–60% is desirable in consideration of the impregnation and strength of the solidifying material paste.

The present invention has a feature to use three measures such as (1) preparing protecting film to the solidifying materials at the surface of the amphoteric metal, (2) enhancing hydration reaction of the solidifying materials, (3) decreasing basicity of the solidifying materials in order to suppress the reaction between the solidifying materials and the amphoteric metals by adding reagents. Although each of the above measures has a function to reduce the amount of the hydrogen gas generation even alone, but further large advantages can be obtained if a plurality of the measures are applied. Particularly, the reagents used in the case (1) has a tendency to retard the hydration reaction of the cement, concurrent use with the means (2) is preferable. Accordingly, the third object can be realized by applying at least two measures out of the above three measures.

DETAILED DESCRIPTION OF THE EMBODIMENTS

Embodiment 1

The first embodiment of the present invention is relating to a case when calcined ashes yielded from a calcining treatment of papers, woods, and resins etc which are generated from a nuclear power plant are solidified in a vessel with a mixture of hydraulic solidifying material of a cement group, protecting film forming reagents, and hydration reaction enhancing reagents to form a stable waste form.

Figure 1:
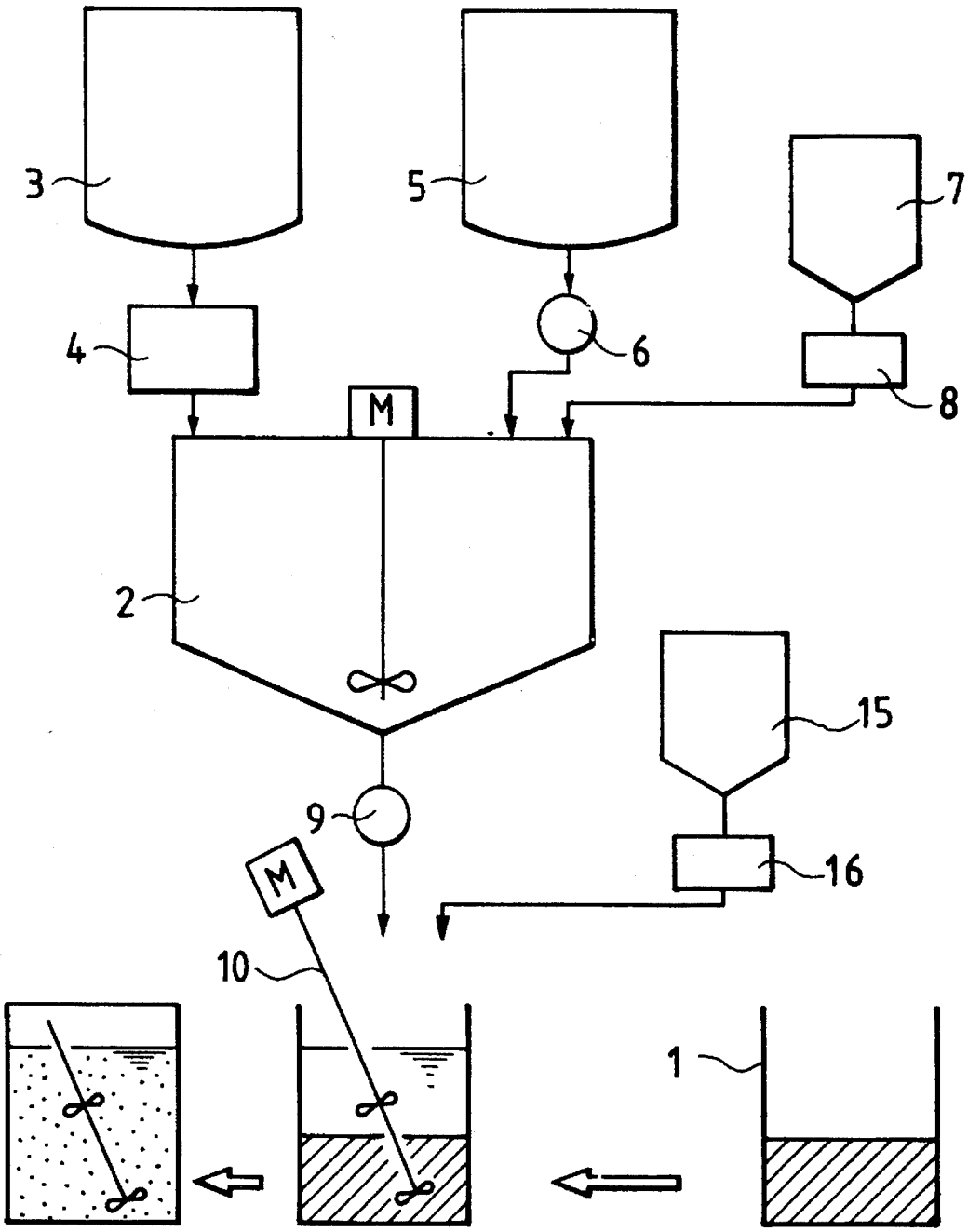
FIG. 1 is a flow chart showing the first embodiment of the present invention.

Referring to FIG. 1, the present embodiment is explained. First, a designated amount of calcined ashes are loaded into the solidifying vessel 1. An ordinary drum can may be used as the solidifying vessel, but the one lined with cement is preferable. A designated amount of the solidifying material is supplied to the mixer 2 from the solidifying material storage tank 3 through the weight feeder 4, and a designated amount of mixing water is added to the mixer 2 from the water tank 5 through the magnetic valve 6. Further, a designated amount of a reagent which is selected from the reagents relating to the present invention for forming protecting film at the surface of the amphoteric metals is supplied to the mixer 2 from the tank of reagents for forming protecting film 7 through the weight feeder 8. The reagent may be mixed with the solidifying materials or mixing water previously, or, the tank of reagents for forming protecting film 7 may be attached to the solidifying materials storage tank 3 or the water tank 5 so that the reagents for forming protecting film may be mixed with the solidifying materials or mixing water. In the former case, the tank of reagents for forming protecting film 7 and the weight feeder 8 become unnecessary. Mixing blade of the mixer 2 is desirably kept operating during the above supplying. An addition of reducing water agents of β-naphthalene group by 1–5% to the solidifying material can decrease water/solidifying material ratio to improve characteristics of the prepared waste form. After mixing for a predetermined time, prepared paste is transferred to the solidifying vessel 1 through the shutter 9. At that time, a designated amount of a reagent which is selected from the reagents relating to the present invention for enhancing hydration reaction is supplied to the solidifying vessel 1 from the tank of reagents for enhancing hydration reaction 15 through the weight feeder 16. The mixing blade 10 is settled into the mixture, and the calcined ashes and the paste of the solidifying material are mixed homogeneously. The mixing blade 10 has a separating mechanism, and after mixing of a predetermined time, the mixing blade is separated from a driving mechanism, a lid is placed on the solidifying vessel 1, and the mixture is cured as it is to complete the waste form. The mixing blade 10 can be used repeatedly by being not separated but withdrawn from the mixture. The hydration enhancing reagents can be previously mixed with the solidifying materials, but an addition to the solidifying material paste at the time when the paste is supplied to the solidifying vessel 1 is desirable in order to ensure a pot life at the mixer 2. Hydraulic solidifying material powder of a cement group is stored in the solidifying materials storage tank 3, and the cement having $R_2O$ value, which indicates basicity of the cement, of utmost 0.4% is preferable. Previous mixing with aggregates is also applicable.

Next, a concrete embodiment is explained hereinafter.

Composition of the calcined ashes used for the present embodiment is indicated in Table 1.

TABLE 1

| Components | $SiO_2$ | $Al_2O_3$ | MgO | Pb | Zn |
|---|---|---|---|---|---|
| Composition (% by weight) | 45 | 15 | 14 | 500 ppm | 300 ppm |

As indicated in Table 1, the calcined ashes contained a large amount of aluminum and its oxides, lead, and zinc, all of which react with cement. First, ordinary portland cement was used as the solidifying material for solidification of the above calcined ashes by filling mixed paste having water/cement ratio of 0.4. Ratio by volume of the calcined ashes and the solidifying material paste was 1:1. As the result, voids and cracks which were deemed to be traces of hydrogen generation were generated in the prepared waste form. Therefore, sulfate resisting cement having rather weak basicity as the cement, silicon polyphosphate as the reagent for protecting film forming, and calcium nitrate as the hydration reaction enhancing reagent were used for preparing the waste form from the calcined ashes under the same condition as the case described above except the reagents.

TABLE 2

| Components | Composition (Parts by weight) |
|---|---|
| Sulfate resisting cement | 40 |
| Silica fume | 30 |
| River sand | 30 |
| Silicon polyphosphate | 1–10 |
| Calcium nitrate | 1–5 |
| Reducing water agent | 1–3 |
| Mixing water | 30–40 |

As the result, the solidified waste form did not have any generation of voids and cracks. Therefore, it became possible to prepare stable waste forms. A water immersion test was performed on the waste form, but there was no change in appearance of the waste form and integrity was maintained.

As previously described in the present embodiment, any of white cement, Pozzolan cement, blust-furnace slag cement, and fly ash cement etc can be used instead of sulfate resisting portland cement. Further, any of blust-furnace slag, fly ash, and chamotte etc can be used instead of silica fume. As for the protection film forming reagent, any of lithium salt and nitrates of polyphosphoric acid, phosphonic acid and its salts, inorganic and organic phosphoric acid and their salts, amines, and mercaptan group can be used instead of silicon polyphosphate. As for the hydration reaction enhancing reagent, any of calcium chloride, water glass, and calcium aluminate etc can be used instead of calcium nitrate.

Hereinafter, effects of the protection film forming reagent and the hydration reaction enhancing reagent are explained.

First, in order to examine the effect of the protection film forming reagent in cement, a corrosion test of aluminum pieces in supernatant liquid of cement paste was performed. As effects of hydration reaction of the cement could be eliminated by using the supernatant liquid, the test was adequate for examining pure effect of the protection film forming reagent. Cements used in the corrosion test were the ordinary portland cement and sulfate resisting portland cement used in the embodiment 1, and these cements had such difference in their composition as shown in Table 3.

TABLE 3

| Component | Sulfate resisting portland cement | Ordinary portland cement |
|---|---|---|
| $SiO_2$ | 22 | 22 |
| $Al_2O_3$ | 5 | 4 |
| CaO | 64 | 65 |
| $Na_2O$ | 0.12 | 0.35 |
| $K_2O$ | 0.20 | 0.55 |

Values are percentage by weight.

The above table indicates that the sulfate resisting portland cement contains less basic components such as $Na_2O$ and $K_2O$ than the ordinary portland cement in order to enhance resistance to sulfates, and accordingly, the sulfate resisting portland cement is preferable cement for realizing the objects of the present invention.

The method of the corrosion test is explained hereinafter.

First, supernatant liquids of the each cements were prepared by respectively mixing the cement of 100 parts by weight and service water of 100 parts by weight sufficiently with an agitator, and subsequent vacuum filtration of the mixtures. The pH of the supernatant liquids were 13.9 for the ordinary portland cement and 13.4 for the sulfate resisting portland cement respectively. Taking the supernatant liquid of 100 cc into a testing tube, and the test was initiated by immersing an aluminum test piece of 1 gram into the supernatant liquid. The generated hydrogen gas was collected by a water replacement method, and its volume was measured. Used reagents were silicon polyphosphate which is one of polyphosphates, nitro-tris-methylene phosphonic acid which is one of organic phosphoric acid, calcium chloride, and lithium nitrate. The additive amount of the reagents was 1 part by weight to the supernatant liquid of 100 parts by weight.

Figure 2:
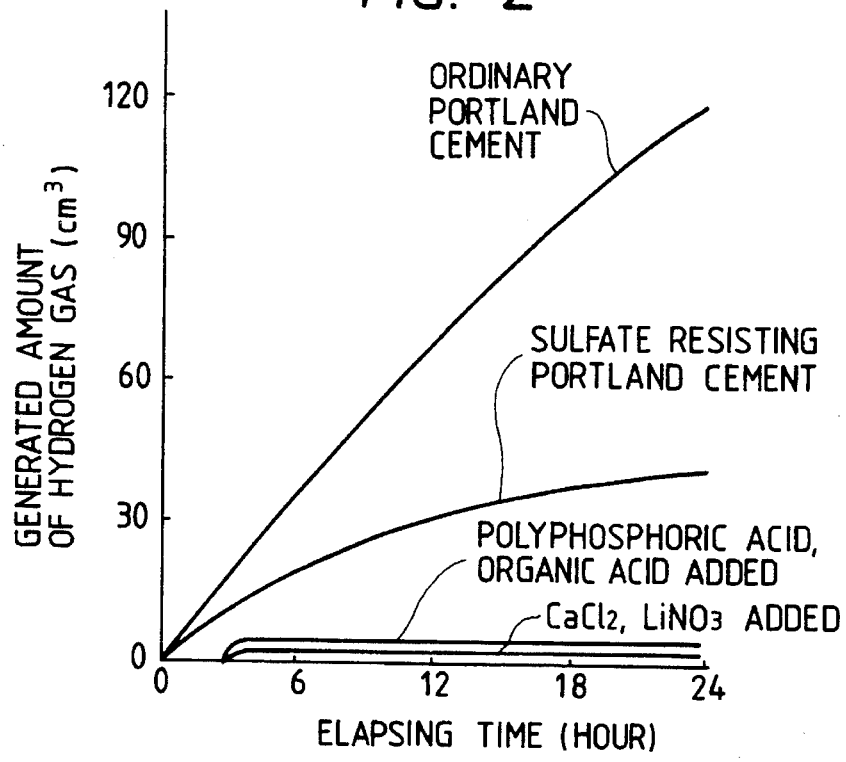
FIG. 2 is a graph showing experimental results on the effects of reagents for forming protecting films, and indicating amounts of hydrogen gas generation depending on elapsing time when the amphoteric metal and the cement were mixed together.

Changes in generated amount of hydrogen gas depending on elapsing time in the corrosion test are indicated in FIG. 2. The aluminum test piece in the supernatant liquid of the ordinary portland cement without any additive reagents generated about 120 cc of hydrogen gas in 24 hours, while that of the sulfate resisting portland cement generated 40 cc of hydrogen gas. Furthermore, it was revealed that the generating amount of hydrogen gas from the aluminum test piece in the supernatant liquid could be decreased to 4 cc, one tenth, by adding silicon polyphosphate and nitro-trismethylenephosphonic acid to the supernatant liquid of the sulfate resisting portland cement, and to 2 cc, only one twentieth, by adding calcium chloride and lithium nitrate to the supernatant liquid. After 24 hours elapsed, the aluminum test piece was taken out from the supernatant liquid, and was observed on its surface. As a result, white gel state deposit was precipitated uniformly on the surface of the aluminum test piece which had been immersed in the supernatant liquid containing silicon polyphosphate and nitro-trismethylenephosphonic acid, and the protecting film had been formed. Furthermore, dense crystalline precipitate was deposited on the surface of the aluminum test piece which had been immersed in the supernatant liquid containing calcium chloride and lithium nitrate. Thus, the present corrosion test reveals that dissolving reactions at the surface of the aluminum test piece were suppressed by the formation of the above described precipitated film, and consequently, generation of hydrogen gas was reduced.

As for the second experiment to confirm effects of the protecting film forming reagents, a corrosion test was performed on the aluminum test piece to immerse it into NaOH aqueous solution having 13.5 of pH under the same condition as the previous one. The corrosion reaction of aluminum in NaOH aqueous solution is harder than that in the supernatant liquid of the cement, and the larger amount of hydrogen gas than that in the previous test is generated. As for the additive reagents, nitrates of alkali metals such as sodium nitrate, potassium nitrate, and lithium nitrate, and other salt containing lithium such as lithium chloride were added to be 1 mole/liter.

Figure 3:
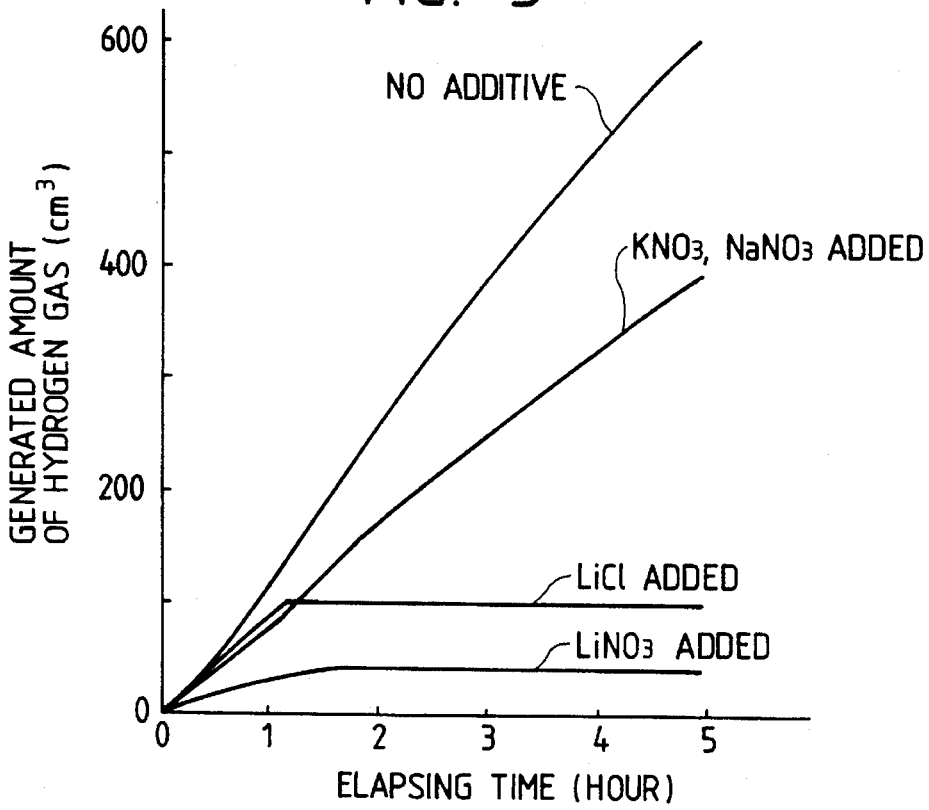
FIG. 3 is a graph showing experimental results on the effects of reagents for forming protecting films, and indicating amounts of hydrogen gas generation depending on elapsing time when the specimens were immersed in a NaOH aqueous solution.

Changes in generated amount of hydrogen gas depending on elapsing time in the second corrosion test are indicated in FIG. 3. The aluminum test piece in NaOH aqueous solution having 13.5 of pH generated about 600 cc of hydrogen gas in 5 hours, while the generated amount of hydrogen gas decreased to 400 cc in the solution added with sodium nitrate and potassium nitrate, to 100 cc in the solution added with lithium chloride, and to 40 cc in the solution added with lithium nitrate. According to the result of the second test, it was revealed that the effect of adding lithium was significant although the effect of nitrate radicals of the added reagents could be observed. In the shape of the curves in FIG. 3 which indicate changes in hydrogen gas generation depending on elapsing time, it can be observed that the curves for cases of lithium added solution become parallel to the abscissa after one hour elapsed. Therefore, it is revealed that the protecting film will become complete after elapsing a while since the aluminum test piece contacted with alkaline solution.

Next, the effect for suppressing hydrogen gas generation, which is caused by reactions of amphoteric metals and cement, by adding hydration reaction enhancing reagents to the solidifying material is explained hereinafter.

As for a standard composition, a paste was prepared by mixing the ordinary portland cement with water in a ratio of water/cement of 0.32, and calcium chloride and calcium nitrate, which was used in the first experiment, were added respectively by 1% to the cement as hydration reaction enhancing reagent for cement. As for reference data, calcium hydroxide was also tested. The method of the experiment was that an aluminum test piece of 1 gram was placed in the cement paste of 50 cc, generated hydrogen gas was collected by water replacement method, and the collected volume of hydrogen gas was measured.

Figure 4:
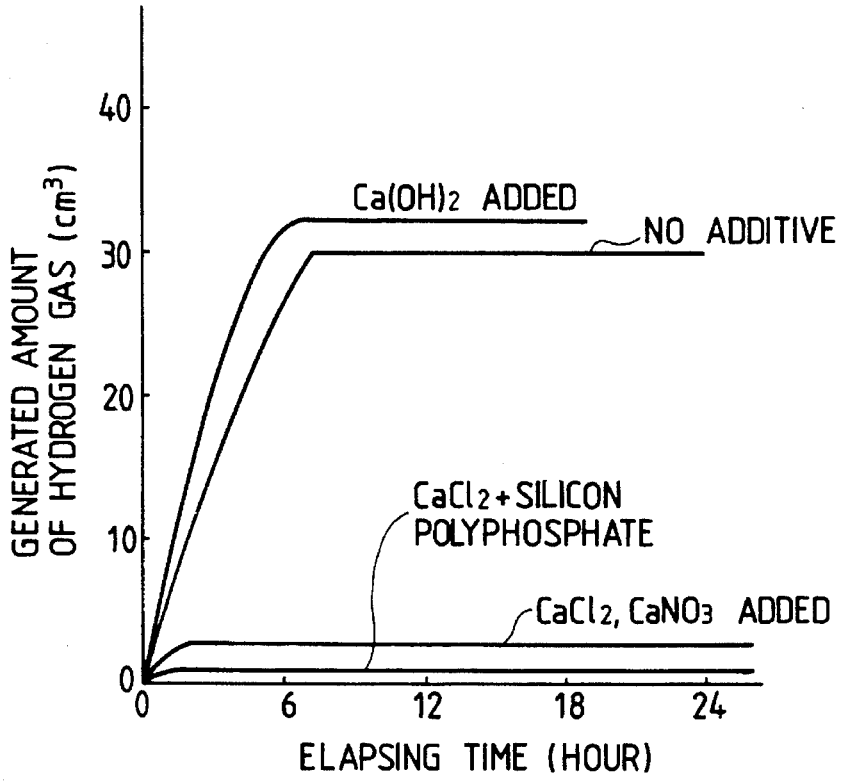
FIG. 4 is a graph showing experimental results on the effects of reagents for enhancing hydration reaction, and indicating amounts of hydrogen gas generation depending on elapsing time when the amphoteric metal and the cement were mixed together.

Changes in generated amount of hydrogen gas depending on elapsing time in the present experiment are indicated in FIG. 4. The aluminum test piece in the paste of the ordinary portland cement generated about 30 cc of hydrogen gas in 6 hours, and after that, the curve of the hydrogen gas generation became parallel to the abscissa. It means that an initial hydration reaction of the ordinary portland cement has completed in 6 hours, and almost of free water contributing to dissolving reaction of the aluminum test piece has been consumed. The hydration reaction of the cement was enhanced in the system to which calcium chloride and calcium nitrate were added, and the curves of the hydrogen gas generation became parallel to the abscissa in about 2 hours. The amount of hydrogen gas generated during the hydration reaction was about 3 cc, one tenth of the case for the no additives. On the other hand, the system to which calcium hydroxide was added did not indicate any enhancing effect for the hydration reaction of the cement, and the amount of hydrogen gas increased somewhat. Accordingly, it was revealed that neutral salts having large solubility among various calcium salts have a significant effect for enhancing the hydration reaction, and salts having small solubility scarcely have such kind of effect.

The same advantages can be obtained by using sodium silicate (water glass), calcium aluminates which are sintered bodies of $CaO.Al_2O_3$, and alunite instead of calcium chloride and calcium nitrate. The additive amount of the reagents are desirably 0.1–10% to the solidifying material, preferably 0.1 –5%, and an sufficient effect has been obtained by an addition of 1%.

Finally, in order to examine the effect of both protecting film forming reagents and hydration reaction enhancing reagents, the same experiment was performed on a system in which 1% calcium chloride and 5% silicon polyphosphate were added as protecting film forming reagents in addition to the hydration reaction enhancing reagents used in the previous experiment. As the result shown in FIG. 4, the amount of generated hydrogen gas became one third of the system in which calcium chloride and calcium nitrate were added. Accordingly, it was revealed that the amount of hydrogen gas generated by the reaction of aluminum, an amphoteric metal, and the cement could be decreased remarkably by concurrent use of reagents for enhancing hydration reaction of cements and reagents for forming protecting film on surface of the amphoteric metals.

As explained above, in accordance with the present embodiment, stable waste forms being prevented from breakage by hydrogen gas generation, solidifying methods therefor, and apparatus thereof can be provided because pre-treatment is unnecessary and generation of combustible hydrogen gas in the waste form can be remarkably decreased.

Furthermore, because the present embodiment is a process in which the calcined ashes of radioactive waste is not loaded into the mixer, there are such advantages that cleaning and maintenance of the mixer can be performed with ease, and a large amount of liquid waste from the cleaning process of the mixer is no radioactive and, accordingly, a decontaminating treatment for the liquid waste does not become necessary.

In the above embodiment, low alkaline cements were used as cement, but the same advantages can be obtained by reducing basicity of the ordinary portland cement. Hereinafter, effects of the reducing basicity of cement is explained.

The present experiment relates to a method in which a method of reducing and adjusting contents of basic components such as $Na_2O$, $K_2O$, and CaO in solidifying materials combines with a method of concurrent use of both protecting film forming reagents and hydration reaction enhancing reagents.

Used cements were the ordinary portland cement and the white cement having a total content of $Na_2O$ and $K_2O$ of 0.4%. In order to reduce and adjust the total content of $Na_2O$ and $K_2O$ in the cement, river sand and blust furnace water granulated slag were added as aggregates for diluting the cement. Preparing conditions for the solidifying material pastes and pH of the pastes are indicated in Table 4.

TABLE 4

| Composition of solidifying material | Water/solidifying material ratio | pH |
|---|---|---|
| A. Ordinary portland cement | 0.3 | 13.8 |
| B. A.40% + sand 30% + slag 30% | 0.25 | 13.4 |
| C. White cement | 0.3 | 13.0 |
| D. C.40% + sand 30% + slag 30% | 0.25 | 12.7 |

Figure 5:
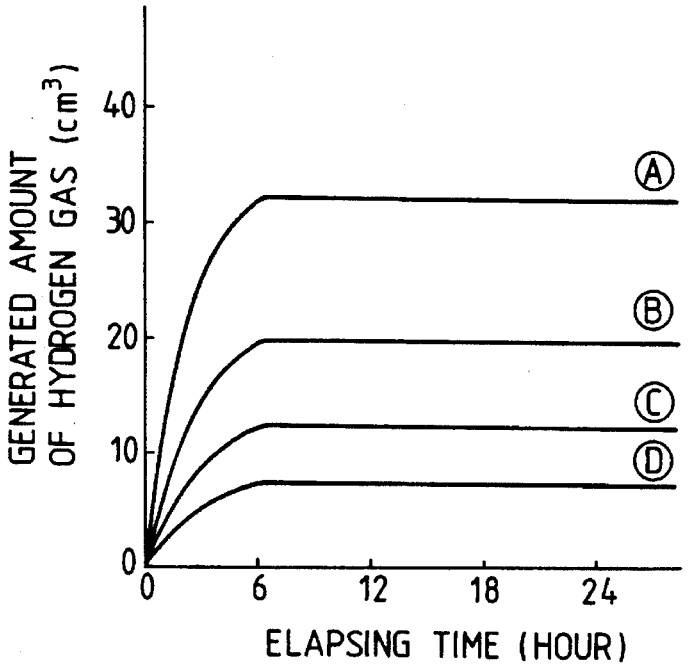
FIG. 5 is a graph showing experimental results on the effects of basicity of the solidifying materials, and indicating amounts of hydrogen gas generation depending on basic component percentage in the cement.

The paste made from the cement of which content of alkaline components such as $Na_2O$ and $K_2O$ were reduced and adjusted had a low pH, and further the pH was reduced by adding aggregate. Zinc granules of 1 gram was added respectively to the above four kinds of pastes of 50 cc each as amphoteric metals, and changes of generated amount of hydrogen gas were measured. The result is shown in FIG. 5. The result revealed that hydrogen gas generation from all of the pastes reached at saturation condition after about six hours, which were necessary time for completing the initial hydration reaction of the cements, from initiation of the reaction, but the generated amounts of hydrogen gas depended on the values of pH of the pastes, and the generated amount of hydrogen gas became less when the value of pH was low.

In accordance with the present embodiment, it is confirmed that the method in which the content of $Na_2$0 and $K_2$0, the alkaline components, in the cement are reduced and adjusted, and further aggregate is added to the paste is effective in reducing hydrogen gas generation.

Figure 6:
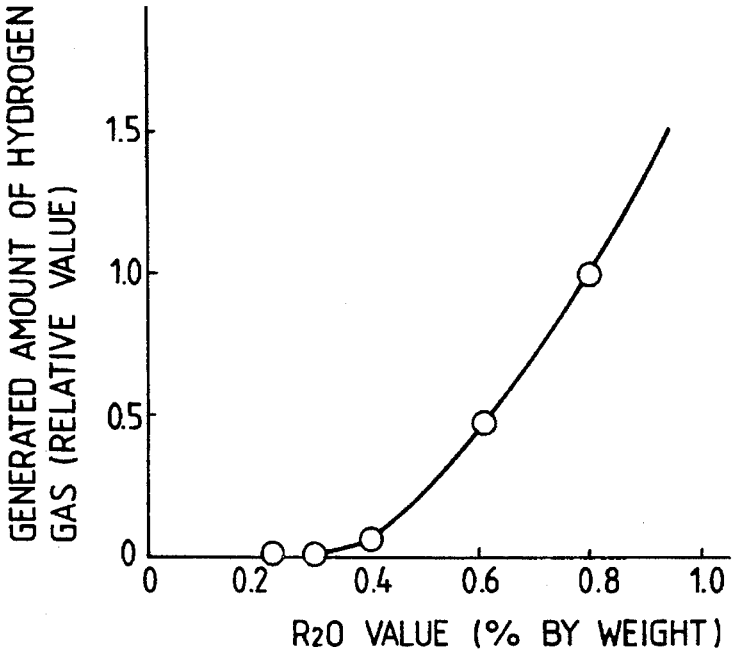
FIG. 6 is a graph showing experimental results on the effects of basicity of the solidifying materials, and indicating a relationship between the amounts of hydrogen gas generation and the $R_2O$ values.

A relationship between a total content ($R_2O$ value) of $Na_2O$ and $K_2O$ in the cement and relative generated amount of hydrogen gas from the zinc granules is shown in FIG. 6. In accordance with the relationship, the $R_2O$ value must be adjusted to utmost 0.6%, preferably utmost 0.4%, in order to reduce the amount of hydrogen gas generated by the reaction of the amphoteric metal with the cement.

Figure 7:
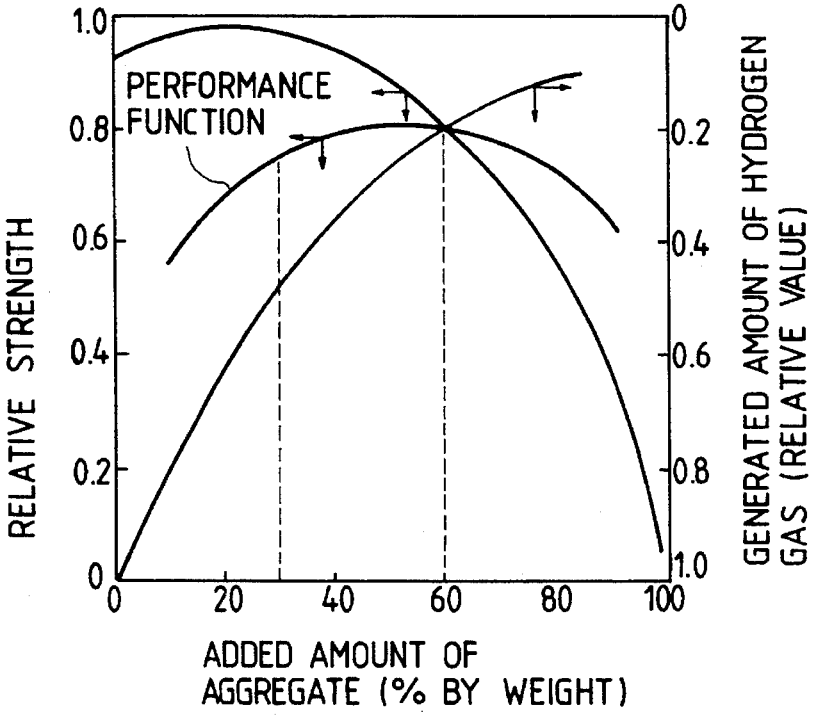
FIG. 7 is a graph showing experimental results on the effects of basicity of the solidifying materials, and indicating relationships between the additive amount of the aggregate and relative strength of the waste form, and the amount of hydrogen gas generation and the performance function.

Next, relationships between the added amount of the aggregate and the generated amount of hydrogen gas (relative value), relative strength of waste form, and a performance function which is obtained as an arithmetical means of the above two values, are shown in FIG. 7. According to FIG. 7, it is revealed that the more amount of aggregate is added, the more effective it becomes for reducing hydrogen gas generation. On the contrary, adding the aggregate more than 80% causes insufficient strength of the waste form, and therefore, addition of the aggregate utmost 80% is preferable. Further, increasing additive amount of aggregate accompanies increment of paste viscosity, and injection index is lowered and injectable property becomes worse. Accordingly, preferable additive amount of the aggregate was 30–60% of the total weight of the solidifying materials.

As a reagent for forming protection film on surface of the zinc granules, sodium alkylbenzenesulfonate was added by 1% to the paste having the D. composition. The molecule of sodium alkylbenzenesulfonate has both hydrophilic group and hydrophobic group, and protects surface of the metal by orientating the hydrophilic group to the metal and the hydrophobic group to the cement paste. As the result, the generated amount of hydrogen gas decreased to one fifth of the case D composition. Furthermore, the generated amount of hydrogen gas decreased to further a half by adding 1% calcium chloride as a hydration reaction enhancing reagent.

As described above, it is possible to decease the amount of hydrogen gas generated by the reaction of amphoteric metal by reducing basicity of the solidifying material. Accordingly, the generated amount of hydrogen gas can be reduced to nearly zero by adding the method for reducing basicity of the solidifying material to the present embodiment 1.

Embodiment 2

The second embodiment of the present invention is relating to a case when calcined ashes yielded from a calcining treatment of papers, woods, and resins etc which are generated from a nuclear power plant are solidified in a vessel to form a stable waste form as well as the first embodiment.

Figure 8:
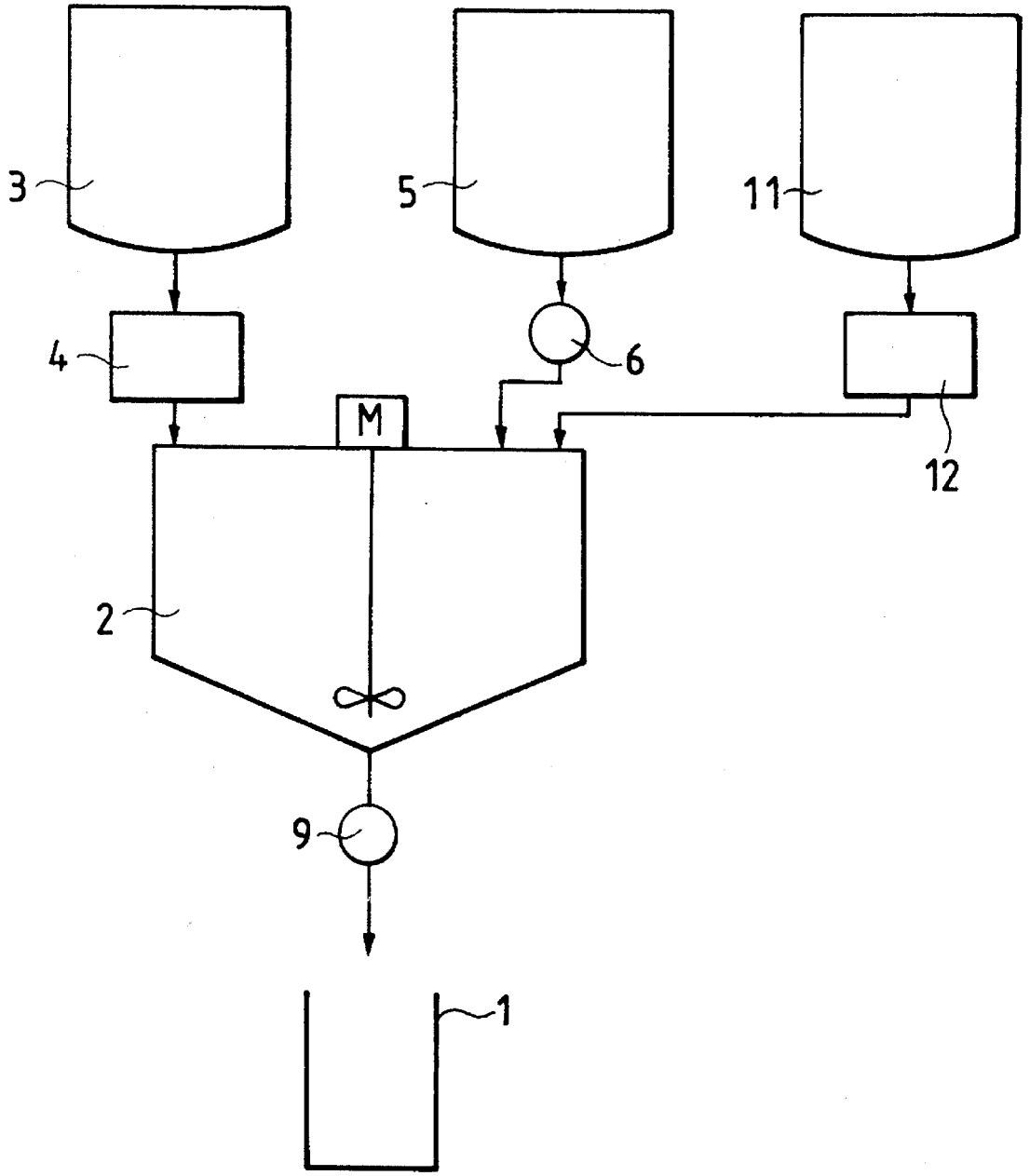
FIG. 8 is a flow chart showing the second embodiment of the present invention, and indicating a solidifying apparatus suitable for solidifying calcined ashes.

The second embodiment is explained referring to FIG. 8. In the present embodiment, a process is the same as the embodiment 1 in which a designated amount of solidifying material is supplied to the mixer 2 from the solidifying material storage tank 3 through the weight feeder 4, subsequently, a designated amount of mixing water is supplied to the mixer 2 from the water tank 5 through the magnetic valve 6, and the supplied materials are mixed for a designated time. In the solidifying material storage tank 3, powder of hydraulic solidifying material of cement group is stored. As for the hydraulic solidifying material, cement having a $R_2O$ value, which indicates basicity of the cement, of utmost 0.4% is preferable. Further, it is possible to mix aggregate previously. A reagent selected from protection film forming reagents relating to the present invention and a hydration reaction enhancing reagent are previously mixed with the solidifying material. Subsequently, a designated amount of the calcined ashes are supplied to the mixer 2 from the calcined ashes storage tank 11 through the weight feeder 12, and are mixed with the solidifying material. After mixing for a predetermined time, the prepared paste is supplied to the solidifying vessel 1 through the shutter 9, and is cured with a lid to complete a waste form.

In accordance with the second embodiment, stable waste forms being prevented from breakage by hydrogen gas generation, solidifying methods therefor, and apparatus thereof can be provided as well as the first embodiment because pre-treatment is unnecessary and generation of combustible hydrogen gas in the waste form can be remarkably decreased.

Furthermore, because of capability of high shearing force and high speed mixing with the mixer 2, homogeneity of the waste form is improved and filling capacity for the calcined ashes can be increased.

Embodiment 3

As for the third embodiment, a preferable system for solidification of metallic waste generated from nuclear power plants is explained hereinafter.

Figure 9:
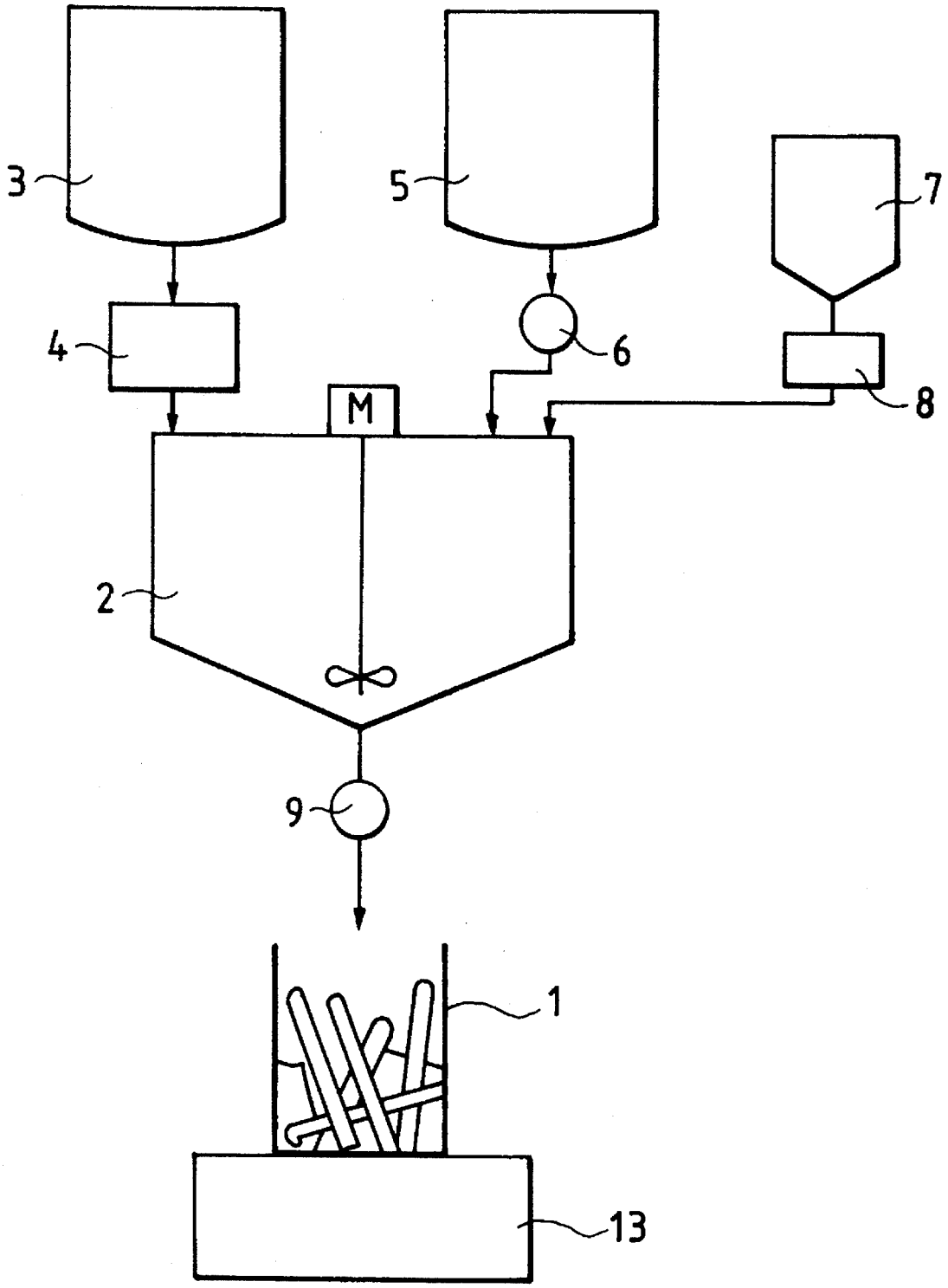
FIG. 9 is a flow chart showing the third embodiment of the present invention, and indicating a solidifying apparatus suitable for solidifying incombustible miscellaneous solid waste.

The third embodiment is explained referring to FIG. 9.

First, miscellaneous metallic waste which are cut to pieces of adequate sizes are filled into the solidifying vessel 1, and the vessel 1 is placed on the vibrator 13. As for the solidifying vessel 1, an ordinary drum can be used, but the one lined with concrete is preferable. A designated amount of solidifying material is supplied to the mixer from the solidifying material storage tank 3 through the weight feeder 4, and a designated amount of mixing water is added to the solidifying material from the water tank 5 through the magnetic valve 6. Further, a designated amount of a reagent selected from protection film forming reagents relating to the present invention is supplied to the mixer 2 from the reagent tank 7 through the weight feeder 8. When the reagent is previously mixed with the solidifying material, the reagent tank 7 and the weight feeder 8 become unnecessary. Mixing blade of the mixer 2 preferably keeps its operation during the above loading. Water/solidifying material ratio can be reduced by adding water reducing reagent of β-naphthalene group of 1–5 to the solidifying material, and characteristics of the prepared waste form can be improved by the reduction of the water. The mixing blade of the mixer 2 preferably has a function to evaluate viscosity of the paste from the loading on the driving motor of the mixer 2. After mixing for a designated time, the prepared paste is supplied to the solidifying vessel 1 through the shutter 9. Subsequently, filling of the solidifying material into spaces among the waste can be enhanced by operating the vibrator 13 to give vibration to the solidifying vessel.

In the solidifying material storage tank 3, powder of hydraulic solidifying material of cement group is stored. As for the hydraulic solidifying material, cement having a $R_2O$ value, which indicates basicity of the cement, of utmost 0.4% is preferable. Further, it is possible to mix aggregate previously for reducing basicity of the cement. Hydration reaction enhancing reagents can be previously mixed with the solidifying material, but in order to ensure a pot life at the mixer 2, the hydration reaction enhancing reagents are preferably added when the solidifying material paste is supplied to the solidifying vessel 1. Accordingly, in the present embodiment, a designated amount of a reagent selected from the hydration reaction enhancing reagents relating to the present invention is added into the solidifying vessel 1 from the hydration reaction enhancing reagent tank 15 through the weight feeder 16 when the paste is supplied to the mixer 2 as well as the first embodiment.

In the above embodiment, the protection film forming reagent is added with the solidifying material for preparing the paste, but the same object can be achieved by immersing the metallic waste directly into an aqueous solution of the protection film forming reagent to form the protection film before supplying the metallic waste into the solidifying vessel 1.

Figure 10:
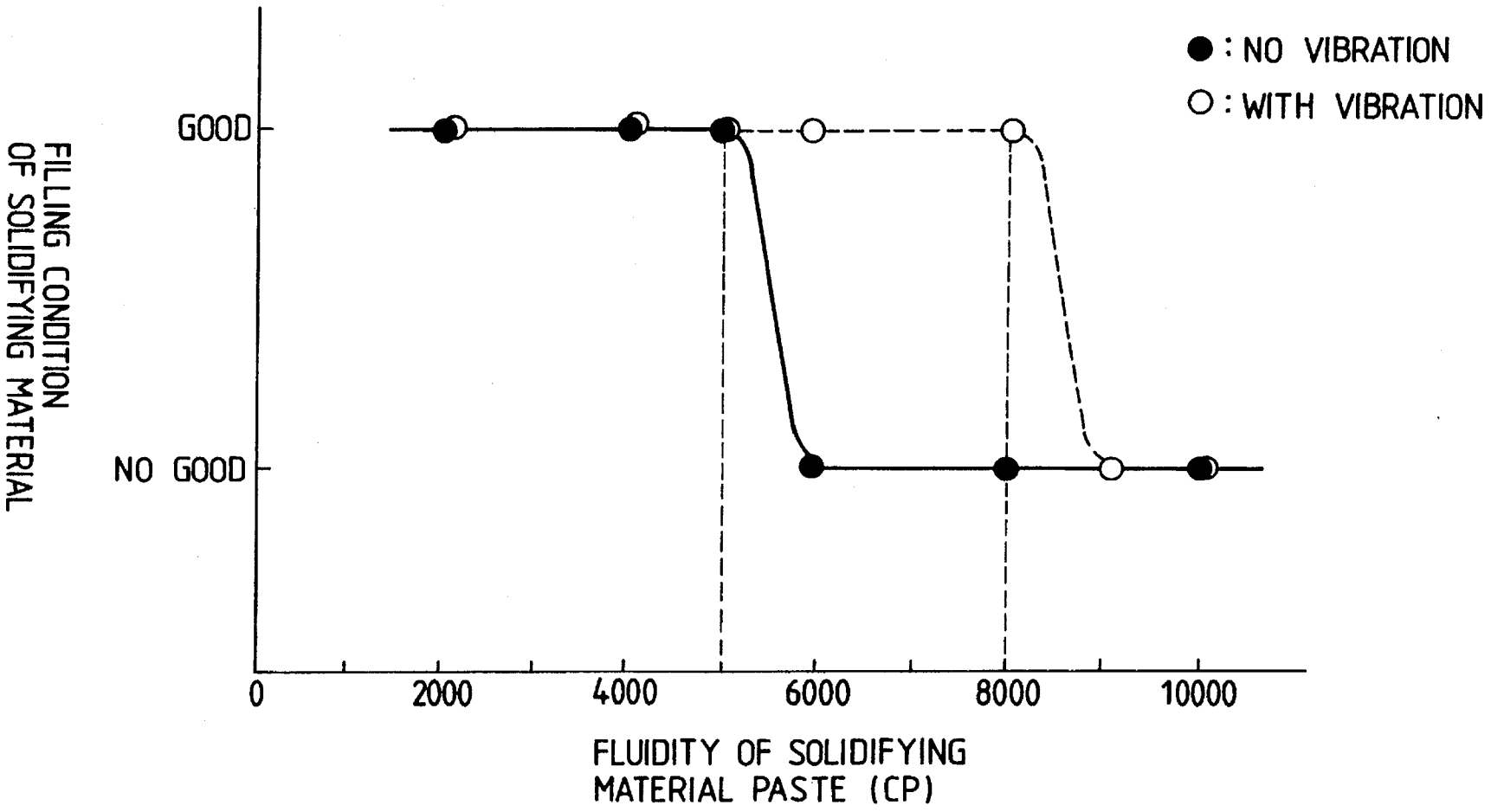
FIG. 10 is a graph showing a relationship between the fluidity of the solidifying material paste and filling conditions of the solidifying material.

In the third embodiment, the solidifying material having the composition shown in Table 2 which was used in the embodiment 1 was used. First, injection property of the solidifying material was evaluated. Evaluation of filled condition was performed in a manner that, after the cement hardened, the solidified body was cut in a vertical direction, and was determined as preferable when void area at the cross section was less than 10%. The result is shown in FIG. 10. When viscosity of the solidifying material paste which was evaluated from the loading on the driving motor for the mixing blade of the mixer 2 was less than 5000 cp, the filling condition of the solidifying material paste was preferable even without vibration. However, when the viscosity was from 5000 cp to 8000 cp, the preferable filling condition was obtained with vibration. Accordingly, the metallic waste can be solidified with ease by controlling the viscosity of the solidifying material paste less than 8000 cp, and subsequently injecting the paste into a solidifying vessel which is filled with the metallic waste. The above method does not need a mixing process of the metallic waste and solidifying material, and therefore, the solidification facility can be simplified.

The waste form solidified by the method of the third embodiment does not have any voids and cracks, and it becomes possible to prepare an intact waste from. The waste form did not show any change in appearance after a water immersion test, and kept its integrity.

In accordance with the third embodiment, stable waste forms being prevented from breakage by hydrogen gas generation, solidifying methods therefor, and apparatus thereof can be provided as well as the previous two embodiments because pre-treatment is unnecessary and generation of combustible hydrogen gas in the waste form can be remarkably decreased.

Furthermore, a method for solidifying waste which is capable of suppressing an amount of hydrogen gas generated by a reaction of amphoteric metal contained in the waste and the solidifying materials in the pre-treatment process by previously forming protection film at surface of the waste before the solidification can be provided.

Embodiment 4

Figure 11:
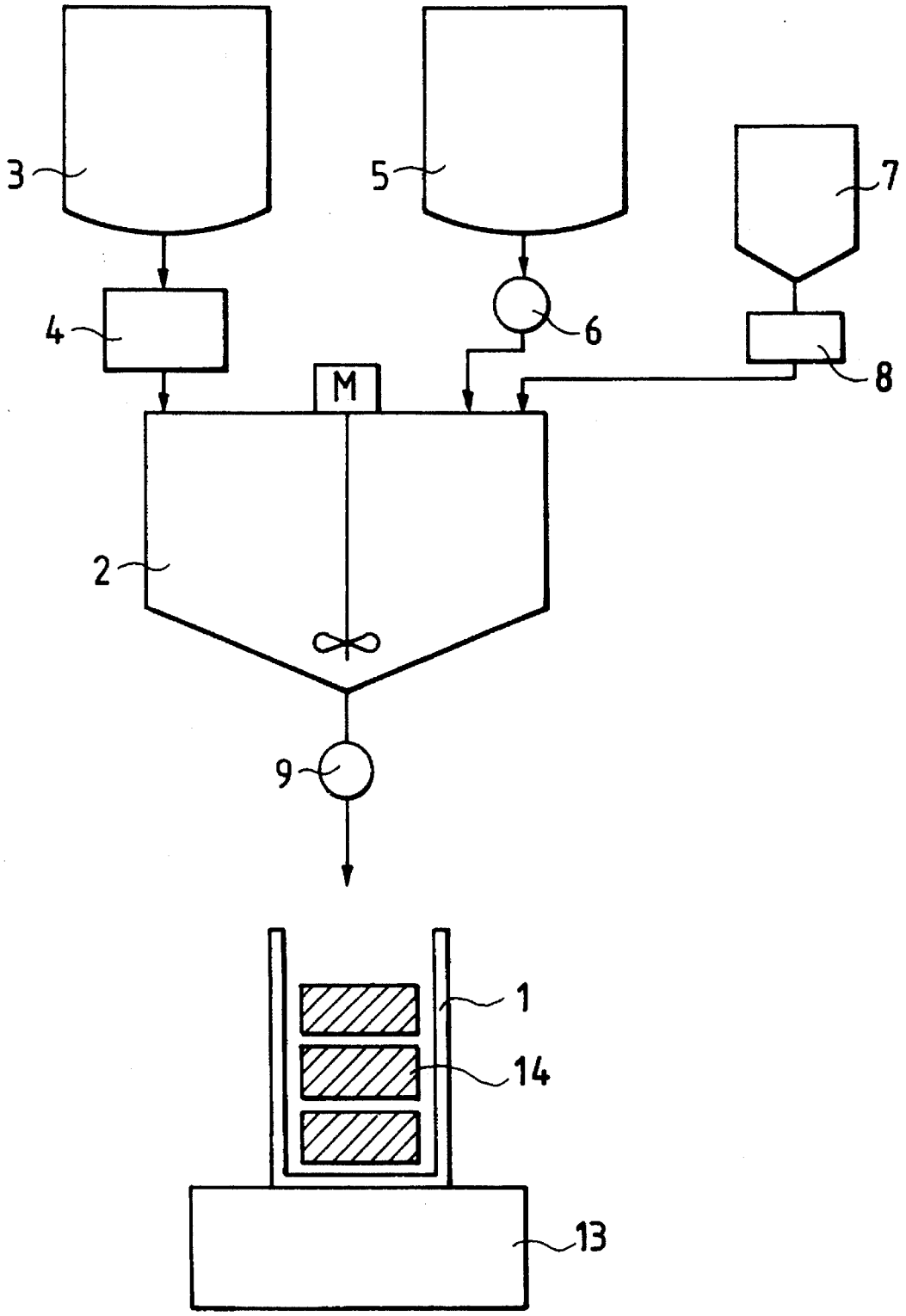
FIG. 11 is a flow chart showing the fourth embodiment of the present invention, and indicating a solidifying apparatus suitable for solidifying hardened bodies of the incombustible miscellaneous solid waste.

Finally, the fourth embodiment is explained referring to FIG. 11. The fourth embodiment is basically the same as the third embodiment. Different points are those that, as showing in FIG. 11, after making the incombustible miscellaneous solid waste of compacted bodies 14 by pressing and reducing its volume and of hardened bodies after melting treatment, or making the calcined ashes of pellets, the above bodies or pellets are placed in the solidifying vessel 1, and are solidified by injecting the paste into the vessel.

In accordance with the present embodiment, the same advantage as the third embodiment can be obtained.

In accordance with the present invention, the following advantages can be realized;

First, in a process for solidifying treatment of waste with basic solidifying material, a method for solidifying waste in which pre-treatment and separating process are not necessary, characteristics of the solidifying material can be utilized sufficiently, and an amount of hydrogen gas generated by the reaction of amphoteric metals contained in the waste with the solidifying material can be suppressed, solidifying apparatus therefor, waste form thereof, and the solidifying material therefor can be provided.

Second, in a process for solidifying treatment of waste with basic solidifying material, a method for solidifying waste in which an amount of hydrogen gas generated by the reaction of amphoteric metals contained in the waste with the solidifying material can be reduced to almost zero, solidifying apparatus therefor, waste form thereof, and the solidifying material therefor can be provided.

Finally, in a process for solidifying treatment of waste with basic solidifying material, a method for solidifying waste in which an amount of hydrogen gas generated by the reaction of amphoteric metals contained in the waste with the solidifying material can be reduced to almost zero, solidifying apparatus therefor, and waste forms in which generation of hydrogen gas is reduced to almost zero can be provided.

What is claimed is;

1. A method for solidifying radioactive waste comprising the steps of:

loading said radioactive waste including amphoteric metals into a solidifying vessel, mixing solidifying material including hydraulic solidifying materials of cement group in a mixing vessel with an additive reagent for forming protective film to prevent generation of hydrogen gas at surface of said amphoteric metals and mixing water to produce a paste, pouring said paste from the mixing vessel into said solidifying vessel loaded with said radioactive waste, mixing the paste with the radioactive waste to form a uniform mixture within said solidifying vessel, and allowing said mixture to stand for enough time to solidify said paste and to obtain a solidified body containing said radioactive waste.

2. A method for solidifying radioactive waste including amphoteric metals with hydraulic solidifying materials of cement group, comprising the steps of:

forming a protection film to prevent generation of hydrogen gas at surface of said amphoteric metals with a reagent, mixing at least said solidifying materials with mixing water to produce a paste, and solidifying said radioactive waste with said paste.

3. A method for solidifying radioactive waste including amphoteric metals with hydraulic solidifying materials of cement group, comprising the steps of:

mixing a reagent forming a protection film to prevent generation of hydrogen gas at surface of said amphoteric metals and said solidifying materials, with mixing water to produce a paste, loading said radioactive waste into a solidifying vessel, and injecting said paste into said solidifying vessel to solidify said radioactive waste with said paste.

4. A method for solidifying radioactive waste including amphoteric metals with hydraulic solidifying materials of cement group, comprising the steps of:

mixing a reagent for forming a protection film to prevent generation of hydrogen gas at surface of said amphoteric metals, said solidifying materials, mixing water and said radioactive waste to produce a mixed body, and loading said mixed body into a solidifying vessel to solidify said radioactive waste therein.

5. A method for solidifying radioactive waste including amphoteric metals with hydraulic solidifying materials of cement group, comprising the steps of:

mixing at least said solidifying material and mixing water to produce a paste, forming a protection film to prevent generation of hydrogen gas at surface of said amphoteric metals with a reagent, and solidifying said radioactive waste with said paste after formation of said protection film.

6. A method for solidifying radioactive waste as claimed in claim 1, wherein:

said reagent is selected from inorganic phosphoric acid and their neutral salts, organic phosphoric acid and their neutral salts (phosphonic acid salts), polyphosphoric acid and their neutral salts, silicon polyphosphate, silic acid and their neutral salts, polysilic acid and their neutral salts, nitrates, inorganic salts including lithium, organic compounds including elements having high electronegativity at polar group, and chelating agents for amphoteric metals.

7. A method for solidifying radioactive waste as claimed in claim 1, wherein:

said radioactive waste includes any one of incombustible miscellaneous solid waste generated from nuclear power plant and calcined ashes generated by calcining treatment of combustible waste.

8. A method for solidifying radioactive waste as claimed in claim 1, wherein:

said solidifying material is treated with a reagent for lowering basicity of said solidifying material.

9. A method for solidifying waste as claimed in claim 1, wherein:

said protection film comprises any one of oxide film, precipitated film, and adsorbed film.

10. A method for solidifying waste as claimed in claim 1, wherein:

said protection film for preventing generation of hydrogen gas is formed on the surfaces of said amphoteric metal.

11. A method for solidifying radioactive waste comprising the steps of:

loading said radioactive waste including amphoteric metals into a solidifying vessel, mixing solidifying material including hydraulic solidifying materials of cement group in a mixing vessel with an additive reagent for enhancing hydration reaction of said solidifying material and mixing water to produce a paste, pouring said paste from the mixing vessel into said solidifying vessel loaded with said radioactive waste, and allowing said paste to stand for sufficient time to solidify and to obtain a solidified body within said solidifying vessel.

12. A method for solidifying waste as claimed in claim 11. wherein:

said reagent is selected from inorganic salts including calcium, sodium silicate (water glass), calcium aluminate which is a sinter body of $CaO.Al_2O_3$, and alunite.

13. A method for solidifying waste as claimed in claim 11, wherein:

said radioactive waste includes any one of incombustible miscellaneous solid waste generated from nuclear power plant and calcined ashes generated by calcining treatment of combustible waste.

14. A method for solidifying waste as claimed in claim 11, wherein;

said solidifying material is treated with both a reagent for enhancing hydration reaction of said solidifying material and a reagent for lowering basicity of said solidifying material.

15. A method for solidifying waste as claimed in claim 11, wherein;

said radioactive waste is treated with a reagent for forming protection film for preventing generation of hydrogen gas, and said solidifying material is treated with a reagent for enhancing hydration reaction of said solidifying material.

16. A method for solidifying waste as claimed in claim 11, wherein;

said radioactive waste is treated with a reagent for forming protection film for preventing generation of hydrogen gas, and said solidifying material is treated with both a reagent for enhancing hydration reaction of said solidifying material and a reagent for lowering basicity of said solidifying material.

17. A method for solidifying waste as claimed in claim 8, wherein;

said reagent for lowering basicity of said solidifying material is a reagent which replaces $Na_2O$, $K_2O$, and CaO, which are basic component of said solidifying material, with inorganic materials which are main component of the reagent to reduce and adjust the content of $Na_2O$, $K_2O$, and CaO in said solidifying material.

* * * * *